US012540624B1

(12) United States Patent
Lin

(10) Patent No.: US 12,540,624 B1
(45) Date of Patent: Feb. 3, 2026

(54) AXIAL FAN ROTOR FOR REVERSIBLE FLOW

(71) Applicant: AMD Design, LLC, Wilmington, DE (US)

(72) Inventor: Ting Yu Lin, Fairfield, NJ (US)

(73) Assignee: AMD Design, LLC, Wilmington, DE (US)

( * ) Notice: Subject to any disclaimer, the term of this patent is extended or adjusted under 35 U.S.C. 154(b) by 0 days.

(21) Appl. No.: 18/937,197

(22) Filed: Nov. 5, 2024

(51) Int. Cl.
*F04D 19/00* (2006.01)
*F04D 29/32* (2006.01)

(52) U.S. Cl.
CPC ..... *F04D 19/005* (2013.01); *F04D 29/325* (2013.01)

(58) Field of Classification Search
CPC ..... F04D 19/005; F04D 29/325; F04D 29/181
See application file for complete search history.

(56) References Cited

U.S. PATENT DOCUMENTS 10,662,973 B2 * 5/2020 Yamazaki ..... F04D 29/384
2012/0213650 A1 * 8/2012 Lee ..... F04D 27/004 417/423.7

* cited by examiner

*Primary Examiner* — Sabbir Hasan
(74) *Attorney, Agent, or Firm* — SCULLY, SCOTT, MURPHY & PRESSER, P.C.

(57) ABSTRACT

An axial fan rotor includes a central hub configured to rotate in a forward direction and in a reverse direction and a plurality of fan blades attached to an outer circumference of the central hub. Each of the fan blades includes a forward direction leading portion, a forward direction trailing portion, a reverse direction leading portion, and a reverse direction trailing portion. The forward direction leading portion and the forward direction trailing portion are configured to force air towards a front or a rear of the central hub when the central hub is rotated in the forward direction. The reverse direction leading portion and the reverse direction trailing portion are configured to force air towards another of the front or the rear of the central hub when the central hub is rotated in the reverse direction. In this way, bi-directional flow may be achieved without significantly impacting performance.

16 Claims, 6 Drawing Sheets

AXIAL FAN ROTOR FOR REVERSIBLE FLOW

FIELD

This disclosure is directed to axial flow fans, especially those used in computing environments for heat dissipation.

BACKGROUND

Fans are often used to facilitate heat transfer, especially in electronic devices. For example, fans are often used to gather heat from servers (or components of servers) in data centers and transfer it to other areas (e.g., outside of the servers, to a center area, a floor area, out of the room). Conventional fan blades are often configured to rotate in a single direction. The fan blades are configured to produce good flows while being efficient and quiet while rotating in the single direction.

Many applications, however, benefit from fans that can run in both directions (e.g., forward and reverse). For example, it may be beneficial to effectively reverse an order of components within an air flow (e.g., by changing a direction of one or more fans). Reversing conventional fan blades often leads to decreased performance in the reverse direction. Often, because the fans are optimized in the forward direction, the fans may need to be run at higher speeds in the reverse direction. This can lead to decreased efficiency (e.g., power consumption) and increased noise.

SUMMARY

An axial fan rotor and associated fan are described herein. The axial fan rotor includes a central hub configured to rotate in a forward direction and in a reverse direction. The axial fan rotor also includes a plurality of fan blades attached to an outer circumference of the central hub. Each of the fan blades includes a forward direction leading portion, a forward direction trailing portion, a reverse direction leading portion, and a reverse direction trailing portion. The forward direction leading portion and the forward direction trailing portion are configured to force air towards a front or a rear of the central hub when the central hub is rotated in the forward direction, and the reverse direction leading portion and the reverse direction trailing portion are configured to force air towards another of the front or the rear of the central hub when the central hub is rotated in the reverse direction.

The associated fan includes the axial fan rotor described above and a motor coupled with the axial fan rotor. The associated fan also includes a housing configured to surround the axial fan rotor.

The foregoing summary is illustrative only and is not intended to be in any way limiting. In addition to the illustrative aspects, embodiments, and features described above, further aspects, embodiments, and features will become apparent by reference to the drawings and the following detailed description. In the drawings, like reference numbers indicate identical or functionally similar elements.

DETAILED DESCRIPTION

Overview

Conventional axial fan blades are often configured to produce good flows in a single direction while being efficient and quiet. When such fans are reversed, however, they often suffer from heavily decreased performance. For example, the fans are often required to rotate at higher speeds in order to generate adequate air flow in the reverse direction. Often times, this leads to increased power usage and increased noise.

An axial fan rotor is described herein. The axial fan rotor includes a central hub configured to rotate in a forward direction and in a reverse direction and a plurality of fan blades attached to an outer circumference of the central hub. Each of the fan blades includes a forward direction leading portion, a forward direction trailing portion, a reverse direction leading portion, and a reverse direction trailing portion. The forward direction leading portion and the forward direction trailing portion are configured to force air towards a front or a rear of the central hub when the central hub is rotated in the forward direction. The reverse direction leading portion and the reverse direction trailing portion are configured to force air towards another of the front or the rear of the central hub when the central hub is rotated in the reverse direction.

The axial fan rotor may have similar performance characteristics regardless of rotation direction (e.g., while moving air in a forward direction or in a reverse direction). In this way, bi-directional flow may be achieved without sacrificing performance.

In the following description, numerous specific details are set forth, such as particular structures, components, materials, dimensions, processing steps and techniques, in order to provide an understanding of the various embodiments of the present application. However, it will be appreciated by one of ordinary skill in the art that the various embodiments of the present application may be practiced without these specific details. In other instances, well-known structures or processing steps have not been described in detail in order to avoid obscuring the present application.

Example Environment

Figure 1:
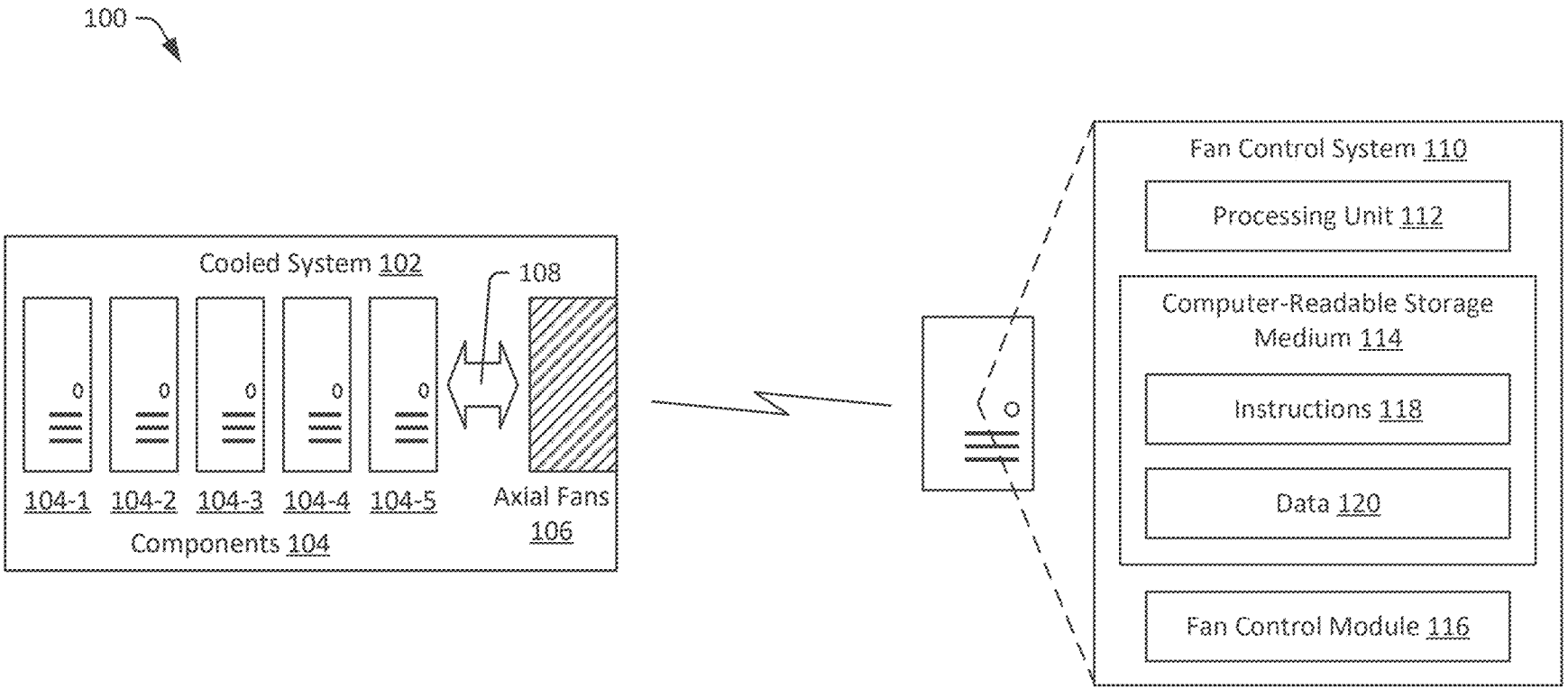
FIG. 1 illustrates an example environment where an axial fan rotor for reversible flow may be used, in accordance with this disclosure.

FIG. 1 illustrates an example of an environment 100 where an axial fan rotor for reversible flow may be used. In the environment 100, there is a cooled system 102. The cooled system 102 may be a server rack or a group of server racks. The cooled system 102 may contain one or more components 104 (e.g., components 104-1-104-5). The components 104 may be servers or other computing devices that generate heat. In some implementations, the cooled system 102 and a component 104 may be portions of a same computing device. For example, the cooled system 102 may be a case of an electronic device or computing device and the components 104 may be components contained therein.

Attached or coupled with the cooled system 102 are one or more axial fans 106. The axial fans 106 are configured to produce air flow 108 around, across, and/or through the components 104 of the cooled system 102. The axial fans 106 include axial fan rotors for reversible flow. By using the aspects of the axial fan rotors discussed below, the axial fans 106 are configured to have good performance (flow, efficiency, and noise) in both rotation directions (e.g., forward and reverse).

Using the cooled system 102 as an example, in a forward rotation direction of the axial fans 106, the air flow 108 may go through components 104-1, 104-2, 104-3, 104-4, and 104-5 before exiting the cooled system 102. In a reverse rotation direction of the axial fans 106, the air flow 108 may go through components 104-5, 104-4, 104-3, 104-2, and 104-1 before exiting the cooled system 102. Thus, by changing the direction of rotations of the axial fans 106, the air flow 108 through the cooled system 102 may switch directions.

In order to control the axial fans 106 (e.g., speeds and rotation directions), there may be a fan control system 110. The fan control system 110 may be communicatively coupled with the axial fans 106 (e.g., via a wired or wireless connection) or otherwise operable to cause the axial fans 106 to rotate in forward and reverse directions. The fan control system 110 includes at least one processing unit 112, at least one computer-readable storage medium 114, and a fan control module 116.

The processing unit 112 (e.g., an application processor, central processor (CPU), graphics processor (GPU), microprocessor, digital-signal processor (DSP), or controller) executes instructions 118 (e.g., code) stored within the computer-readable storage medium 114 (e.g., a non-transitory storage devices such as a hard drive, SSD, flash memory, read-only memory (ROM), EPROM, or EEPROM) to cause the fan control system 110 to perform the techniques described herein. The instructions 118 may be part of an operating system and/or one or more applications of the fan control system 110.

The instructions 118 cause the fan control system 110 to act upon (e.g., create, receive, modify, delete, transmit, or display) data 120 (e.g., application data, module data; sensor data, or I/O data). Although shown as being within the computer-readable storage medium 114, portions of the data 120 may be within a random-access memory (RAM) or a cache of the fan control system (not shown). Furthermore, the instructions 118 and/or the data 120 may be remote to the fan control system 110.

The fan control module 116 (or portions thereof) may be comprised by the computer-readable storage medium 114 or be a stand-alone component (e.g., executed in dedicated hardware in communication with the processing unit 112 and computer-readable storage medium 114). For example, the instructions 118 may cause the processing unit 112 to implement or otherwise cause the fan control module 116 to determine speeds and rotation directions for the axial fans 106 and cause the axial fans 106 to rotate in the determined directions and speeds.

For example, the fan control module 116 may use a timing function to cause the axial fans 106 to run in the forward direction for a given amount of time and then cause the axial fans 106 to run in the reverse direction for the given amount of time. The times in the forward and the reverse directions may be the same or different. In some implementations, the rotation directions of the axial fans 106 may be based on sensor data (e.g., temperature data) from one or more points within the cooled system 102. Regardless of the control scheme used, the fan control module 116 is operable to cause the axial fans 106 to rotate in forward and reverse directions.

Example Axial Fans and Fan Rotors

Figure 2A:
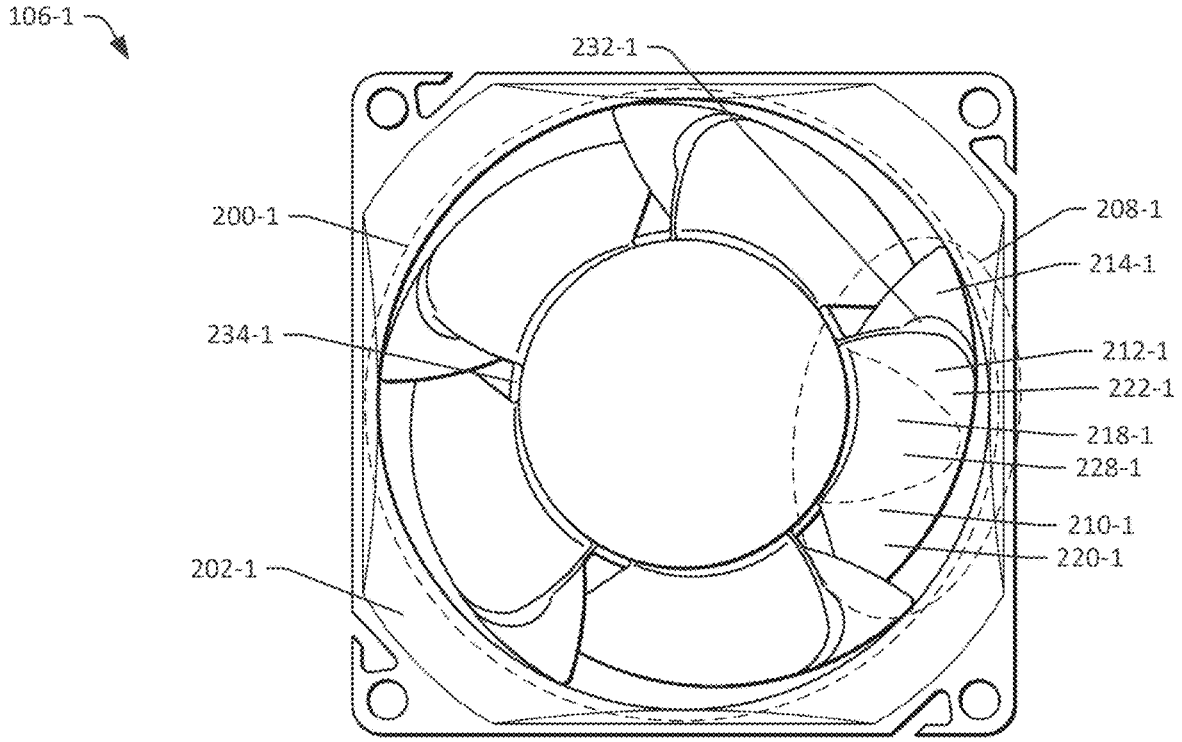
FIG. 2A illustrates a first view of an example axial fan with an axial fan rotor for reversible flow, in accordance with this disclosure.
Figure 3:
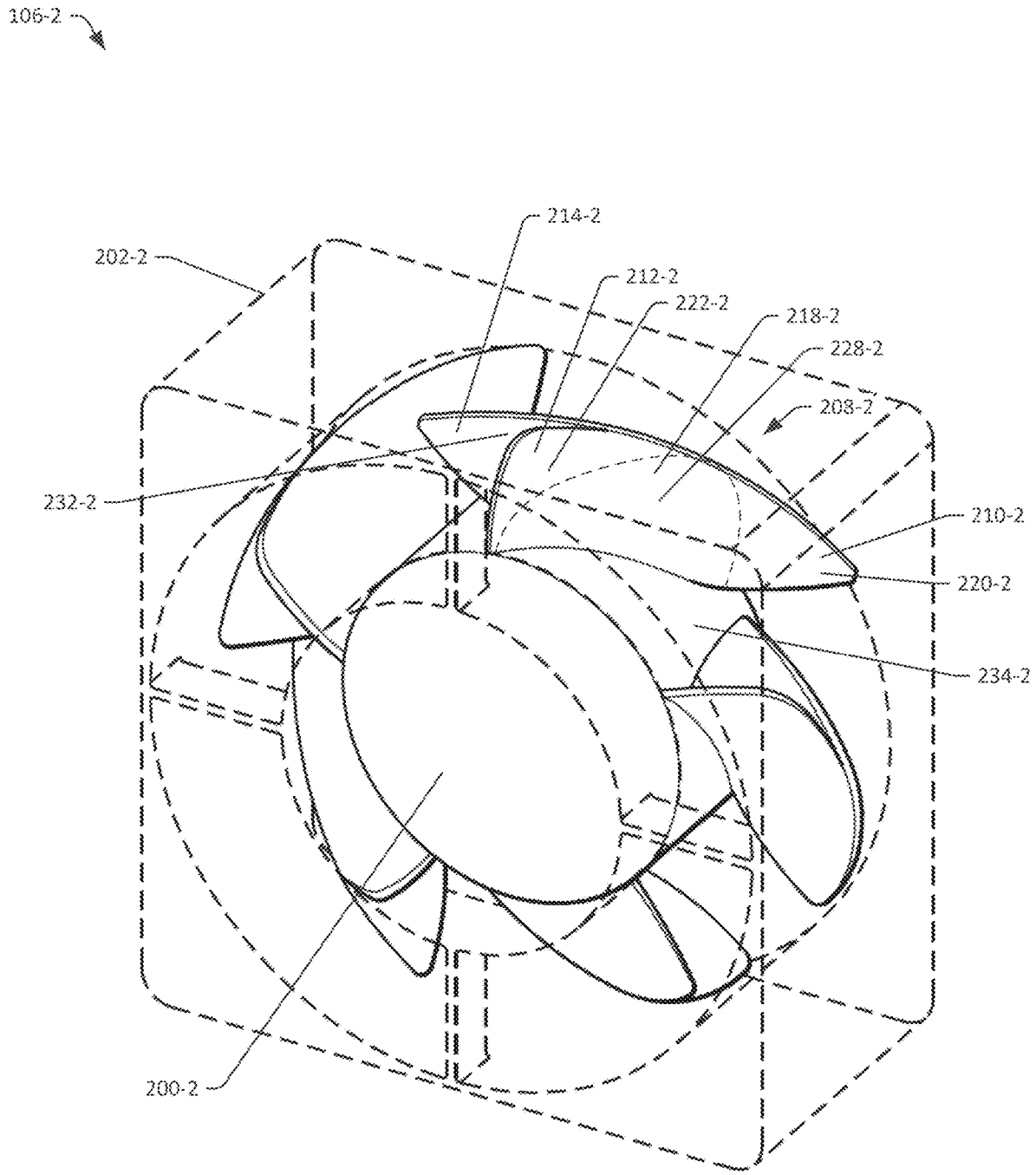
FIG. 3 illustrates another example of an axial fan with an axial fan rotor for reversible flow, in accordance with this disclosure.
Figure 4:
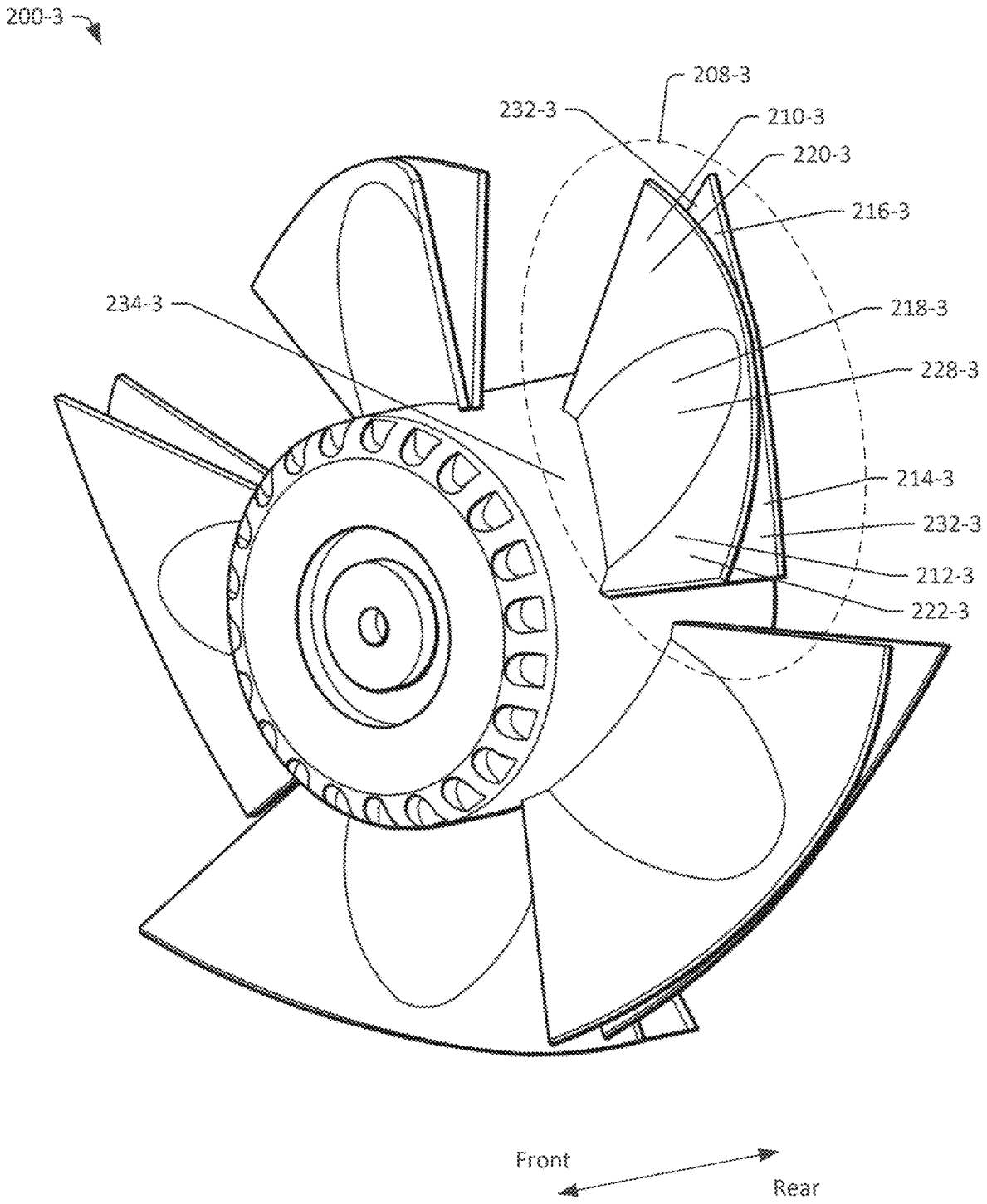
FIG. 4 illustrates another example of an axial fan rotor for reversible flow, in accordance with this disclosure.
Figure 5:
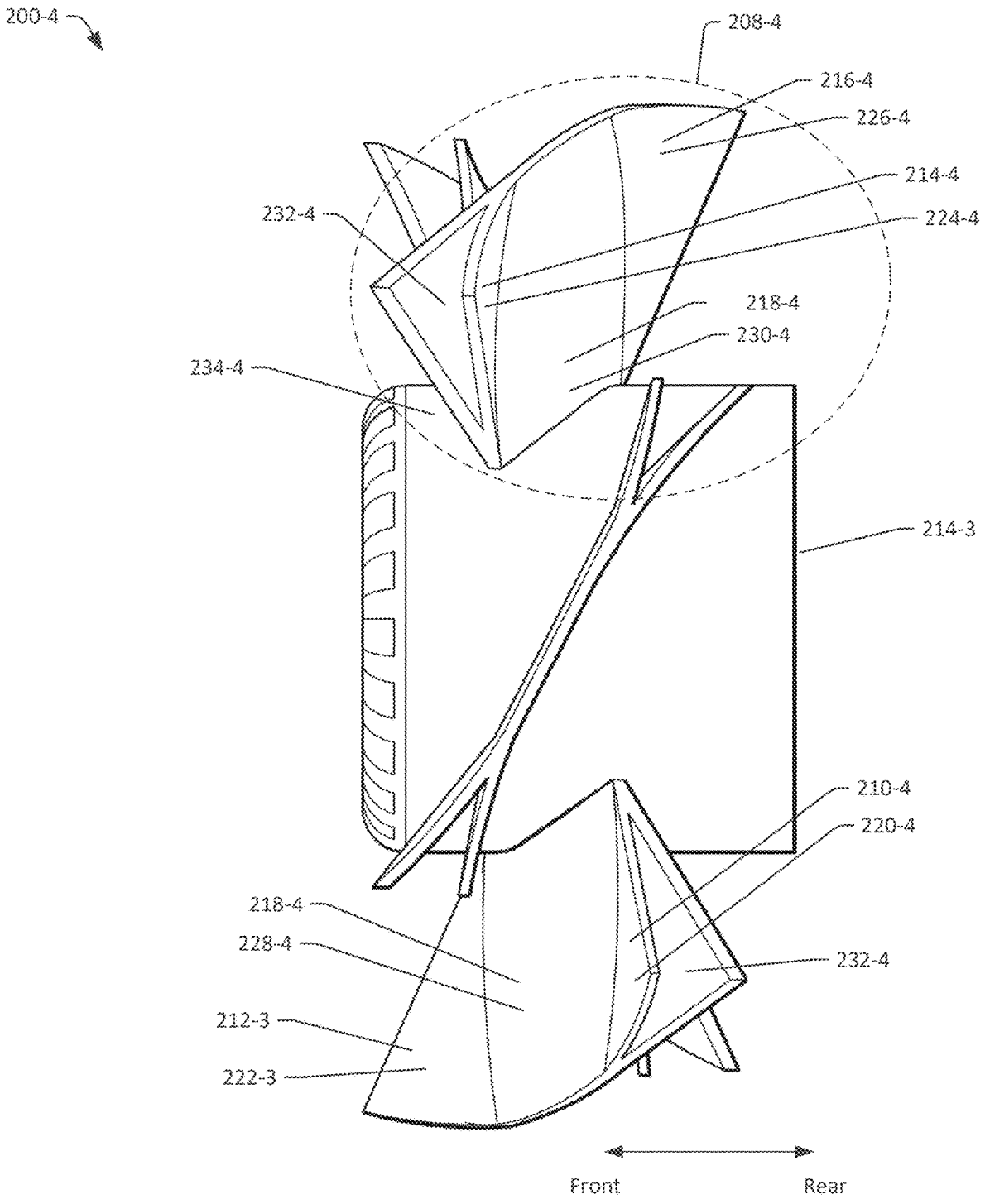
FIG. 5 illustrates another example of an axial fan rotor for reversible flow, in accordance with this disclosure.
Figure 6:
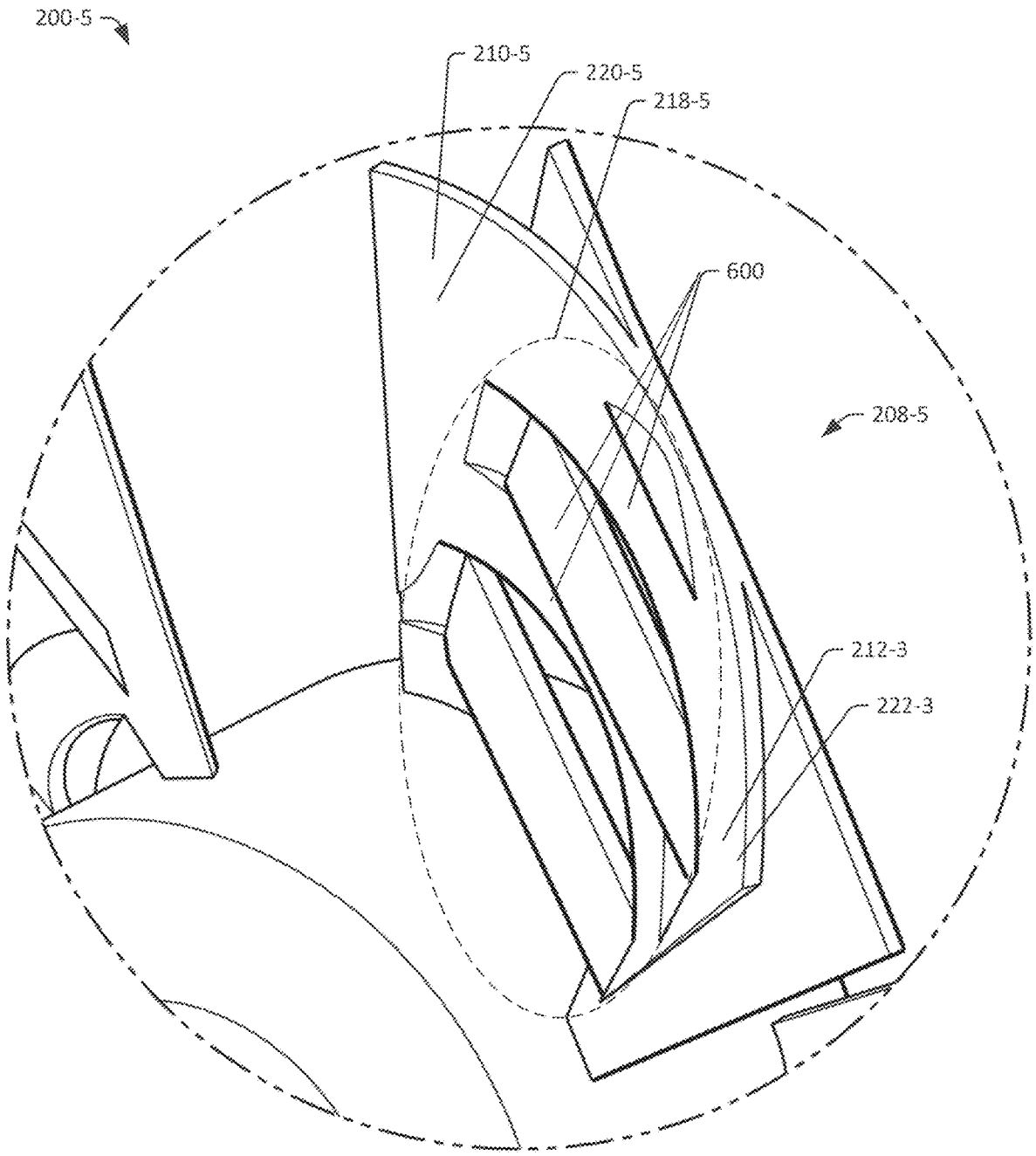
FIG. 6 illustrates another example of an axial fan rotor for reversible flow, in accordance with this disclosure.

Non-dashed numbers are used to describe universal features (or shared aspects) while dashed numbers represent specific examples. FIGS. 2A-3 illustrate two examples of the axial fan 106 (axial fan 106-1 and axial fan 106-2) with respective examples of a fan rotor 200 (fan rotor 200-1 and fan rotor 200-2) configured for reversible flow. FIGS. 4-6 illustrate three more examples of the fan rotor 200 (fan rotor 200-3, fan rotor 200-4, and fan rotor 200-5) configured for reversible flow.

Figure 2B:
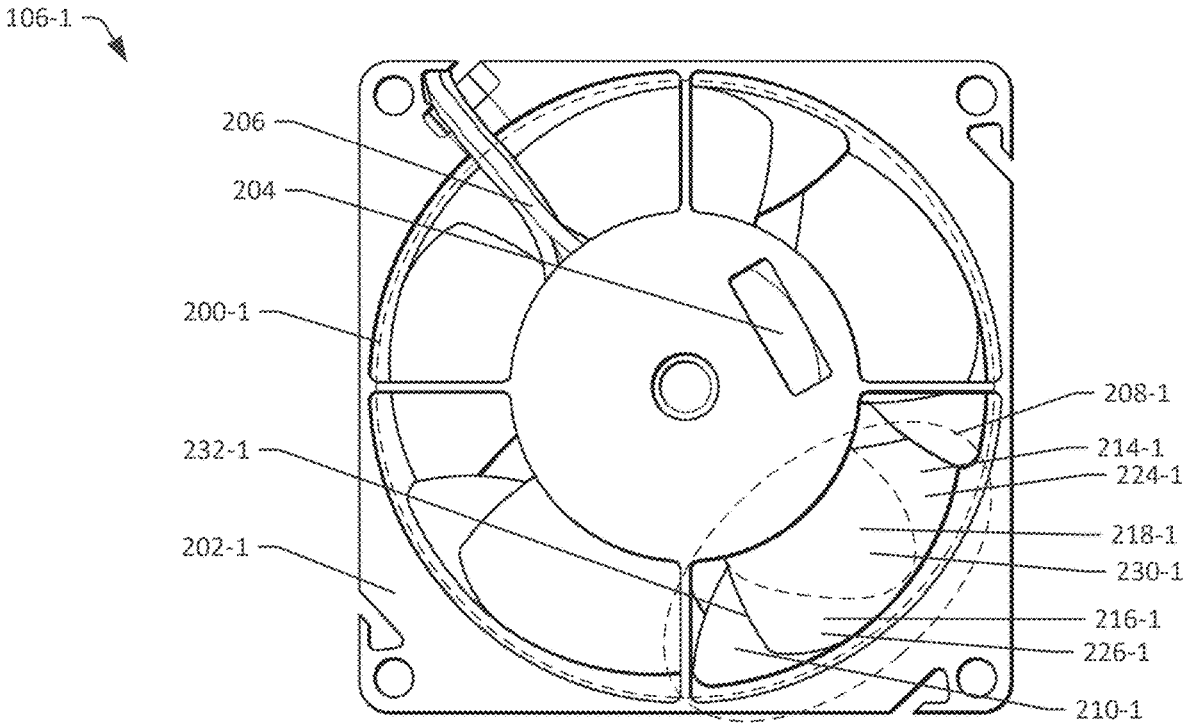
FIG. 2B illustrates a second view of the example axial fan with an axial fan rotor, in accordance with this disclosure.

FIGS. 2A and 2B illustrate front and rear views, respectively, of the axial fan 106-1 that includes the fan rotor 200-1. FIG. 3 illustrates the axial fan 106-2 that includes the fan rotor 200-2. FIG. 4 illustrates the fan rotor 200-3. FIG. 5 illustrates the fan rotor 200-4. FIG. 6 illustrates a portion of the fan rotor 200-5.

Axial fan 106 generally includes the fan rotor 200 and a housing 202 (housing 202-1 and housing 202-2). The housing 202 may be configured to force air flow through the axial fan 106 and/or provide for mounting of the axial fan 106. To do so, the housing 202 may comprise an internal cavity that surrounds the fan rotor 200. Axial fan 106 may also include a motor 204 and associated wiring 206 (shown in axial fan 106-1). The motor 204 may be disposed between the housing 202 and the fan rotor 200 and be configured to cause the fan rotor 200 to rotate in forward and reverse directions. In some implementations, the motor 204 may be external to the axial fan 106 and be mechanically connected to the fan rotor 200 (e.g., via gears or belts) to cause the fan rotor 200 to rotate in the forward and reverse directions.

Attention will now be given to the fan rotor 200. The fan rotor 200 is configured to produce air flow in generally opposite directions based on a rotation direction around a central axis. Furthermore, the fan rotor 200 is configured to achieve good performance in both rotation directions.

The fan rotor 200 has one or more blades 208 (e.g., five in the illustrated examples). The blades 208 may be disposed circumferentially around a central hub 234 of the fan rotor. The blades 208 may be integrally formed with the central hub 234 or attached thereto.

As an example, the fan rotor 200-1 is configured to produce an air flow in a direction out of the page when rotated clockwise in FIG. 2A. In FIG. 2B, as the view is reversed relative to FIG. 2A, the same rotation corresponds to a counter-clockwise rotation of the fan rotor 200-1, which produces an air flow in a direction into the page. Conversely, the fan rotor 200-1 is configured to produce an air flow in a direction into the page when rotated counter-clockwise in FIG. 2A. In FIG. 2B, the same rotation corresponds to a clockwise rotation, which produces an air flow in a direction out of the page. It should be noted that the directions may be switched without departing from the scope of this disclosure. In other words, the blades 208-1 may be configured such that a counter-clockwise rotation in FIG. 2A produces an air flow in the direction out of the page.

To achieve the forward and reverse flows, each blade 208 has a forward direction leading portion 210, a forward direction trailing portion 212, a reverse direction leading portion 214, and a reverse direction trailing portion 216. The forward direction leading portion 210, the forward direction trailing portion 212, the reverse direction leading portion 214, and the reverse direction trailing portion 216 may be joined via a center portion 218.

The center portion 218 may be defined as an area where a cross section through the blade 208 (e.g., a slice of the blade 208) may not have any open space. In other words, the center portion 218 may be a solid portion that the forward direction leading portion 210, the forward direction trailing portion 212, the reverse direction leading portion 214, and the reverse direction trailing portion 216 all connect to.

The blade 208 also includes leading and trailing surfaces. For example, the forward direction leading portion 210 may include a forward direction leading surface 220 and the forward direction trailing portion 212 may include a forward direction trailing surface 222. The reverse direction leading portion 214 may include a reverse direction leading surface 224 and the reverse direction trailing portion 216 may include a reverse direction trailing surface 226. Similarly, the center portion 218 may include a forward direction center surface 228 and a reverse direction center surface 230. The forward direction surfaces may create a contiguous surface that creates the air flow in the forward direction (e.g., towards the front of the axial fan 106) during the forward rotation. The reverse direction surfaces may create a continuous surface that creates the air flow in the reverse (e.g., rear) direction during the reverse rotation.

The center portions 218-1 and 218-2 (including forward direction center surfaces 228-1 and 228-2 and reverse direction center surface 230-1) are illustrated as dotted lines, as the surface transitions may be smooth (not defined by a line). A reverse direction center surface of the fan blade 208-2 is not shown, but is generally included within the center portion 218-2. For example, the forward direction center surfaces 228-1 and 228-2 and reverse direction center surfaces 230-1 and the reverse direction center surface of the fan blade 208-2 that is not shown may not be flat and/or may be tangential to the leading and trailing surfaces.

The forward direction leading portion 210 and the forward direction trailing portion 212, in conjunction with one side of the center portion 218, are configured to produce forward air flow when the fan rotor 200 is rotated in a forward direction. Conversely, the reverse direction leading portion 214 and the reverse direction trailing portion 216, in conjunction with another side of the center portion 218, are configured to produce reverse air flow when the fan rotor 200 is rotated in a reverse direction. The rotations and flow directions may vary without departing from the scope of this disclosure.

Leading portion, as used herein, refers to a portion of the blade 208 that hits a portion of air first. That is, a leading portion or surface generally crosses a radial line prior to a trailing portion for a given direction of rotation.

The forward direction leading portion 210 (and forward direction leading surface 220) may be similarly shaped to the reverse direction leading portion 214 (and reverse direction leading surface 224). Similarly, the forward direction trailing portion 212 (and forward direction trailing surface 222) may be similarly shaped to the reverse direction trailing portion 216 (and reverse direction trailing surface 226). The leading and trailing portions/surfaces, however, are generally not symmetrical and are shaped differently to produce good performance for a given rotation direction.

Turning to FIGS. 2A and 2B, it may be seen that the reverse direction trailing portion 216-1, in the perspective of FIG. 2A, is at least mostly blocked by the forward direction leading portion 210-1. As such, the reverse direction trailing portion 216-1 may not have a large negative effect on the performance of the axial fan 106-1 while rotating in the forward direction. While the reverse direction leading portion 214-1 is not occluded in the perspective of FIG. 2A, it too may not have a large negative effect on the performance of the axial fan 106-1 while rotating in the forward direction due to it being minimally in the flow path of the forward direction leading portion 210-1 and the forward direction trailing portion 212-1.

The forward direction leading portion 210 (and surface) may diverge from the reverse direction trailing portion 216 (and surface), and the reverse direction leading portion 214 (and surface) may diverge from the forward direction trailing portion 212 (and surface). For example, as a distance from the central hub 234 increases (e.g., out from a center of the axial fan 106-1 in FIGS. 2A and 2B) and/or as a radius increases from the central hub 234, a gap 232 may increase between the forward direction leading portion 210 (and surface) and the reverse direction trailing portion 216 (and surface) and/or between the reverse direction leading portion 214 (and surface) and the forward direction trailing portion 212 (and surface). The gap may be filled, as in fan blade 208-1, or left open, as in fan blade 208-2 through 208-5.

Turning now to the fan rotor 200-2 shown in FIG. 3, similarities and differences with the fan rotor 200-1 will be discussed. Similar to the fan rotor 200-1, the center portion 218-2 is differentiated from the other portions of the blade 208-2 via a dotted line because the center portion 218-2 may flow tangentially to the other portions of the blade 208-2. Other structures and rotation/flow directions are similar, albeit with different portion shapes. For example, similar to those of the blade 208-1, the gaps 232-2 may increase as a function of distance from the central hub 234-2 and/or as a function of distance from the center portion 218-2.

Different from the blade 208-1, however, the gaps 232-2 in the fan rotor 200-2 are open. That is, there is an air space between the forward direction leading portion 210-2 and the reverse direction trailing portion (not shown) and between the forward direction trailing portion 212-2 and the reverse direction leading portion 214-2. Depending upon implementation, the areas between the forward and reverse portions may be completely open, completely closed, or somewhere in between.

Turning now to the fan rotor 200-3 shown in FIG. 4, similarities and differences with fan rotors 200-1 and 200-2 will be discussed. The fan rotor 200-3 is configured such that the rotation and flow directions are reversed compared to those of fan rotors 200-1 and 200-2. That is, a counterclockwise rotation of the fan rotor 200-3 may produce an air flow towards the front of the fan rotor 200-3, and a clockwise rotation of the fan rotor 200-3 may produce an air flow towards the rear of the fan rotor 200-3. Otherwise, the structures are similar (but differently shaped).

For example, in the blade 208-3, the center portion 218-3 may be flat (e.g., have two parallel surfaces) with some thickness. The center portion 218-3 may, for example, have a thickness equal to that of one of the leading or trailing portions or equal to double that of one of the leading or trailing portions. Different thicknesses (including those of the leading and trailing portions) may be provided depending upon material selection, manufacturing processes, strength requirements, etc. Regardless of thickness, the forward direction center surface 228-3 may be flat, which may produce a sharper edge transition to the forward direction leading surface 210-3 and the forward direction trailing surface 212-3 (seen by the solid arc line). The reverse direction portions of the blade 208-3 may be similar to the forward direction portions of the blade 208-3.

The shapes of the leading and trailing portions (and surfaces) of fan rotor 200-3 are also different than those of fan rotors 200-1 and 200-2. For example, the leading portions do not extend as far past the opposite direction trailing portions. Furthermore, the leading and trailing portions come to sharper points and have generally straight edges.

Turning now to the fan rotor 200-4 shown in FIG. 5, similarities and differences with the fan rotor 200-3 will be discussed. The fan rotor 200-4 is similar to the fan rotor 200-3, except that the respective portions have different shapes/proportions. For example, the center portion 218-4 extends to an edge of the blade 208-4 (instead of stopping short of it). As such, the forward direction leading surface 220-4 may not connect with the forward direction trailing surface 222-4. In the previous examples, those surfaces were in contact with each other. Furthermore, the thickness of the center portion 218-4 may be less than the thickness of the center portion 218-3. In general, the shapes and configurations of the various portions may vary without departing from the scope of this disclosure.

Turning now to the fan rotor 200-5 shown in FIG. 6, the fan rotor 200-5 is similar to the fan rotor 200-4 and the fan rotor 200-3, except that the center portion 218-5 is configured differently. Instead of being solid, similar to the other examples of the center portion 218, the center portion 218-5 is configured with alternating convex and concave slats 600. The concave slats on a forward side of the blade 208-5 (e.g., the left side) may form tangencies with the forward direction leading surface 220-5 and the forward direction trailing surface 222-3. The concave slats on the forward side of the blade 208-5 may correspond to the convex slats on a reverse side of the blade 208-5. Similarly, the concave slats on the reverse side of the blade 208-5 (e.g., the right side which is mostly occluded) may form tangencies with the reverse direction leading surface and the reverse direction trailing surface. The concave slats on the reverse side of the blade 208-5 may correspond to the convex slats on the forward side of the blade 208-5.

Adjacent slats may be sealed therebetween to prevent air from passing between the forward and reverse sides of the center portion 218-5. Conversely, adjacent slats may form air gaps between the forward and reverse sides of the center portion 218-5 that allow air to pass between the forward and reverse sides of the center portion 218-5.

By keeping a portion of the center portion 218-5 concave on each side of the center portion 218-5, better fan dynamics may be achieved than a solid and/or flat center portion 218-5. Accordingly, the fan rotor 200-5 may be configured for good flow characteristics in both rotation directions.

It should be noted that any of the example structures described herein may be interchangeable with other example structures. For example, the center portion 218-5 may be used in conjunction with the other structures of fan rotor 200-2. Similarly, the leading and trailing portions of the fan rotor 200-1 or the fan rotor 200-2 may be used in conjunction with the center portion 218-3. Regardless of configuration, the fan rotor 200 includes the forward direction leading surface 220, the forward direction trailing surface 222, the reverse direction leading surface 224, and the reverse direction trailing surface 226, which may be disposed on the forward direction leading portion 210, the forward direction trailing portion 212, the reverse direction leading portion 214, and the reverse direction trailing portion 216, respectively. Those structures enable the fan rotor 200 to achieve good performance in forward and reverse rotation directions.

Examples

Example 1: An axial fan rotor comprising: a central hub configured to rotate in a forward direction and in a reverse direction; and a plurality of fan blades attached to an outer circumference of the central hub, each of the fan blades including: a forward direction leading portion; a forward direction trailing portion; a reverse direction leading portion; and a reverse direction trailing portion, wherein: the forward direction leading portion and the forward direction trailing portion are configured to force air towards a front or a rear of the central hub when the central hub is rotated in the forward direction; and the reverse direction leading portion and the reverse direction trailing portion are configured to force air towards another of the front or the rear of the central hub when the central hub is rotated in the reverse direction.

Example 2: The axial fan rotor of example 1, wherein: the forward direction leading portion and the forward direction trailing portion have different shapes; and the reverse direction leading portion and the reverse direction trailing portion have different shapes.

Example 3: The axial fan rotor of example 1 or 2, wherein: the forward direction leading portion has substantially a same shape as the reverse direction leading portion; and the forward direction trailing portion has substantially a same shape as the reverse direction trailing portion.

Example 4: The axial fan rotor of example 1, 2, or 3, wherein each of the fan blades includes: a forward direction fill portion between the forward direction leading portion and the reverse direction trailing portion; and a reverse direction fill portion between the reverse direction leading portion and the forward direction trailing portion.

Example 5: The axial fan rotor of any preceding example, wherein the axial fan rotor is formed as a single structure.

Example 6: The axial fan rotor of any preceding example, wherein each of the fan blades includes: a forward direction leading surface on the forward direction leading portion; a forward direction trailing surface on the forward direction trailing portion; a reverse direction leading surface on the reverse direction leading portion; and a reverse direction trailing surface on the reverse direction trailing portion.

Example 7: The axial fan rotor of any preceding example, wherein each of the fan blades forms gaps between: the forward direction leading portion and the reverse direction trailing portion; and the forward direction trailing portion and the reverse direction trailing portion.

Example 8: The axial fan rotor of example 7, wherein the gaps increase as a distance from the central hub increases.

Example 9: The axial fan rotor of any preceding example, wherein each of the fan blades includes a center portion connecting the forward direction leading portion, the forward direction trailing portion, the reverse direction leading portion, and the reverse direction trailing portion.

Example 10: The axial fan rotor of example 9, wherein: each of the fan blades forms gaps between: the forward direction leading portion and the reverse direction trailing portion; and the forward direction trailing portion and the reverse direction trailing portion; and the gaps increase as a distance from the center portion increases.

Example 11: The axial fan rotor of example 9 or 10, wherein the center portion is flat.

Example 12: The axial fan rotor of example 9, 10, or 11, wherein the center portion has a thickness equal to a thickness of the forward direction leading portion, the forward direction trailing portion, the reverse direction leading portion, or the reverse direction trailing portion.

Example 13: The axial fan rotor of example 9, 10, or 11, wherein the center portion has a thickness equal to twice a thickness of the forward direction leading portion, the forward direction trailing portion, the reverse direction leading portion, or the reverse direction trailing portion.

Example 14: The axial fan rotor of example 9 or 10, wherein the center portion includes a plurality of slats that alternate between being convex and concave.

Example 15: The axial fan rotor of example 14, wherein adjacent slats of the slats form a gap configured to allow air to pass therethrough.

Example 16: An axial fan comprising: a motor; an axial fan rotor comprising: a central hub configured to rotate in a forward direction and in a reverse direction; and a plurality of fan blades attached to an outer circumference of the central hub, each of the fan blades including: a forward direction leading surface that is part of a forward direction leading portion; a forward direction trailing surface that is part of a forward direction trailing portion; a reverse direction leading surface that is part of a reverse direction leading portion; and a reverse direction trailing surface that is part of a reverse direction trailing portion, wherein: the forward direction leading surface and the forward direction trailing surface, are configured to force air towards a front or a rear of the central hub when the central hub is rotated in the forward direction; and the reverse direction leading surface and the reverse direction trailing surface are configured to force air towards another of the front or the rear of the central hub when the central hub is rotated in the reverse direction; and a housing with an internal cavity surrounding the axial fan rotor.

Example 17: The axial fan of example 16, wherein each of the fan blades includes a center portion connecting the forward direction leading surface, the forward direction trailing surface, the reverse direction leading surface, and the reverse direction trailing surface.

Example 18: The axial fan of example 17, wherein: a distance between the forward direction leading surface and the reverse direction trailing surface increases as a distance from the center portion increases; and a distance between the reverse direction leading surface and the forward direction trailing surface increases as a distance from the center portion increases.

Example 19: The axial fan of example 18, wherein the center portion includes a series of slats that alternate between being convex and concave.

Example 20: A fan blade comprising: a forward direction leading portion; a forward direction trailing portion; a reverse direction leading portion; and a reverse direction trailing portion, wherein: the forward direction leading portion and the forward direction trailing portion are configured to force air towards a front or a rear of the fan blade when the fan blade is rotated in a forward direction around an axis of rotation; and the reverse direction leading portion and the reverse direction trailing portion are configured to force air towards another of the front or the rear of the fan blade when the fan blade is rotated in a reverse direction around the axis of rotation.

CONCLUSION

The terminology used herein is for the purpose of describing particular embodiments only and is not intended to be limiting of this disclosure. As used herein, the singular forms "a," "an," and "the" are intended to include the plural forms as well, unless the context clearly indicates otherwise. It will be further understood that the terms "includes," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. Further, the terms up, upper, down, lower, above, below, left, right, forward, rearward, and the like are intended to be understood in the context of the representations described and illustrated above so that a wearable device may have such an orientation in reference to the frame or to various elements as supported by the frame or as illustrated in the drawing figures.

The corresponding structures, materials, acts, and equivalents of all means or step plus function elements, if any, in the claims below are intended to include any structure, material, or act for performing the function in combination with other claimed elements as specifically claimed. The description of the present disclosure has been presented for purposes of illustration and description but is not intended to be exhaustive or limited to this disclosure in the form disclosed. Many modifications and variations will be apparent to those of ordinary skill in the art without departing from the scope and spirit of this disclosure. The various embodiments were chosen and described in order to best explain the principles of this disclosure and the practical application, and to enable others of ordinary skill in the art to understand this disclosure for various embodiments with various modifications as are suited to the particular use contemplated.

What is claimed is:

1. An axial fan rotor comprising:

a central hub configured to rotate in a forward direction and in a reverse direction; and a plurality of fan blades attached to an outer circumference of the central hub, each of the fan blades including:

a forward direction leading portion;

a forward direction trailing portion;

a reverse direction leading portion; and a reverse direction trailing portion, wherein:

the forward direction leading portion and the forward direction trailing portion are configured to force air towards a front or a rear of the central hub when the central hub is rotated in the forward direction;

the reverse direction leading portion and the reverse direction trailing portion are configured to force air towards another of the front or the rear of the central hub when the central hub is rotated in the reverse direction;

each of the fan blades forms gaps between:

the forward direction leading portion and the reverse direction trailing portion; and the forward direction trailing portion and the reverse direction leading portion; and the gaps increase as a distance from the central hub increases.

2. The axial fan rotor of claim 1, wherein:

the forward direction leading portion and the forward direction trailing portion have different shapes; and the reverse direction leading portion and the reverse direction trailing portion have different shapes.

3. The axial fan rotor of claim 1, wherein:

the forward direction leading portion has a same shape as the reverse direction leading portion; and the forward direction trailing portion has a same shape as the reverse direction trailing portion.

4. The axial fan rotor of claim 1, wherein each of the fan blades includes:

a forward direction fill portion between the forward direction leading portion and the reverse direction trailing portion; and a reverse direction fill portion between the reverse direction leading portion and the forward direction trailing portion.

5. The axial fan rotor of claim 1, wherein the axial fan rotor is formed as a single structure.

6. The axial fan rotor of claim 1, wherein each of the fan blades includes a center portion connecting the forward direction leading portion, the forward direction trailing portion, the reverse direction leading portion, and the reverse direction trailing portion.

7. The axial fan rotor of claim 6, wherein the gaps increase as a distance from the center portion increases.

8. The axial fan rotor of claim 6, wherein the center portion is flat.

9. The axial fan rotor of claim 6, wherein the center portion has a thickness equal to a thickness of the forward direction leading portion, the forward direction trailing portion, the reverse direction leading portion, or the reverse direction trailing portion.

10. The axial fan rotor of claim 6, wherein the center portion has a thickness equal to twice a thickness of the forward direction leading portion, the forward direction trailing portion, the reverse direction leading portion, or the reverse direction trailing portion.

11. The axial fan rotor of claim 6, wherein the center portion includes a plurality of slats that alternate between being convex and concave.

12. The axial fan rotor of claim 11, wherein adjacent slats of the slats form a gap configured to allow air to pass therethrough.

13. An axial fan comprising:

an axial fan rotor comprising:

a central hub configured to rotate in a forward direction and in a reverse direction; and a plurality of fan blades attached to an outer circumference of the central hub, each of the fan blades including:

a forward direction leading surface that is part of a forward direction leading portion;

a forward direction trailing surface that is part of a forward direction trailing portion;

a reverse direction leading surface that is part of a reverse direction leading portion;

a reverse direction trailing surface that is part of a reverse direction trailing portion; and a center portion connecting the forward direction leading surface, the forward direction trailing surface, the reverse direction leading surface, and the reverse direction trailing surface, wherein:

the forward direction leading surface and the forward direction trailing surface, are configured to force air towards a front or a rear of the central hub when the central hub is rotated in the forward direction;

the reverse direction leading surface and the reverse direction trailing surface are configured to force air towards another of the front or the rear of the central hub when the central hub is rotated in the reverse direction;

a distance between the forward direction leading surface and the reverse direction trailing surface increases as a distance from the center portion increases; and a distance between the reverse direction leading surface and the forward direction trailing surface increases as a distance from the center portion increases;

a motor configured to rotate the axial fan rotor; and a housing with an internal cavity surrounding the axial fan rotor.

14. The axial fan of claim 13, wherein the motor is configured to rotate the axial fan rotor in forward and reverse directions.

15. The axial fan of claim 13, wherein the center portion includes a series of slats that alternate between being convex and concave.

16. A fan blade comprising:

a forward direction leading portion;

a forward direction trailing portion;

a reverse direction leading portion;

a reverse direction trailing portion; and a center portion connecting the forward direction leading portion, the forward direction trailing portion, the reverse direction leading portion, and the reverse direction trailing portion, wherein:

the forward direction leading portion and the forward direction trailing portion are configured to force air towards a front or a rear of the fan blade when the fan blade is rotated in a forward direction around an axis of rotation;

the reverse direction leading portion and the reverse direction trailing portion are configured to force air towards another of the front or the rear of the fan blade when the fan blade is rotated in a reverse direction around the axis of rotation;

the fan blade forms gaps between:

the forward direction leading portion and the reverse direction trailing portion; and the forward direction trailing portion and the reverse direction leading portion; and the gaps increase as a distance from the center portion increases.

* * * * *